US005086301A

United States Patent [19]

English et al.

[11] Patent Number: 5,086,301

[45] Date of Patent: Feb. 4, 1992

[54] POLARIZATION CONVERTER APPLICATION FOR ACCESSING LINEARLY POLARIZED SATELLITES WITH SINGLE- OR DUAL-CIRCULARLY POLARIZED EARTH STATION ANTENNAS

[75] Inventors: William J. English, Derwood; Hans H. Viskum, Rockville, both of Md.

[73] Assignee: Intelsat, Washington, D.C.

[21] Appl. No.: 463,057

[22] Filed: Jan. 10, 1990

[51] Int. Cl.[5] ..... H01Q 21/24

[52] U.S. Cl. ..... 342/188; 342/361; 343/756

[58] Field of Search ..... 342/188, 361-366; 343/756

[56] References Cited

U.S. PATENT DOCUMENTS

| | | | |
|---|---|---|---|
| 3,076,188 | 1/1963 | Schneider . | |
| 3,184,743 | 5/1965 | Crawford . | |
| 4,308,541 | 12/1981 | Seidel et al. . | |
| 4,336,542 | 6/1982 | Bielli et al. . | |
| 4,387,377 | 6/1983 | Kandler | 343/756 |
| 4,568,943 | 2/1986 | Bowman | 343/756 |
| 4,599,623 | 7/1986 | Havkin et al. | 343/756 |
| 4,663,634 | 5/1987 | Fulton | 343/756 |
| 4,686,537 | 8/1987 | Hidaka et al. | 343/756 X |
| 4,714,930 | 12/1987 | Winter et al. | 343/756 X |
| 4,786,914 | 11/1988 | Wu et al. | 343/756 X |

*Primary Examiner*—Mark Hellner

*Attorney, Agent, or Firm*—Sughrue, Mion, Zinn, Macpeak & Seas

[57] ABSTRACT

A single- or dual-circularly polarized earth station antenna is converted into a single- or dual-linearly polarized earth station antenna for accessing linearly polarized satellites. In a first embodiment, a free-space meander line polarizer providing a 90° differential phase shift between two orthogonal polarizations is disposed in front of the earth station antenna feed system. In a second embodiment, a power dividing (transmit) or power combining (receive) network operates in conjunction with differential phase shift circuits to achieve the polarization conversion.

11 Claims, 1 Drawing Sheet

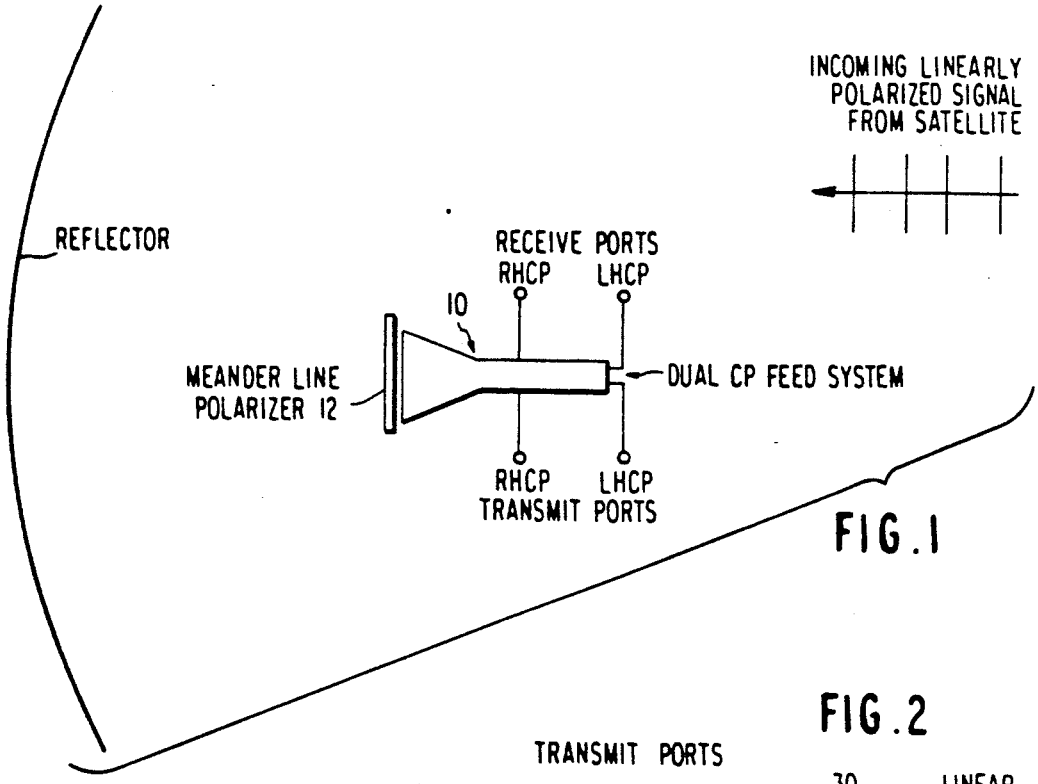
FIG. 1
FIG. 2
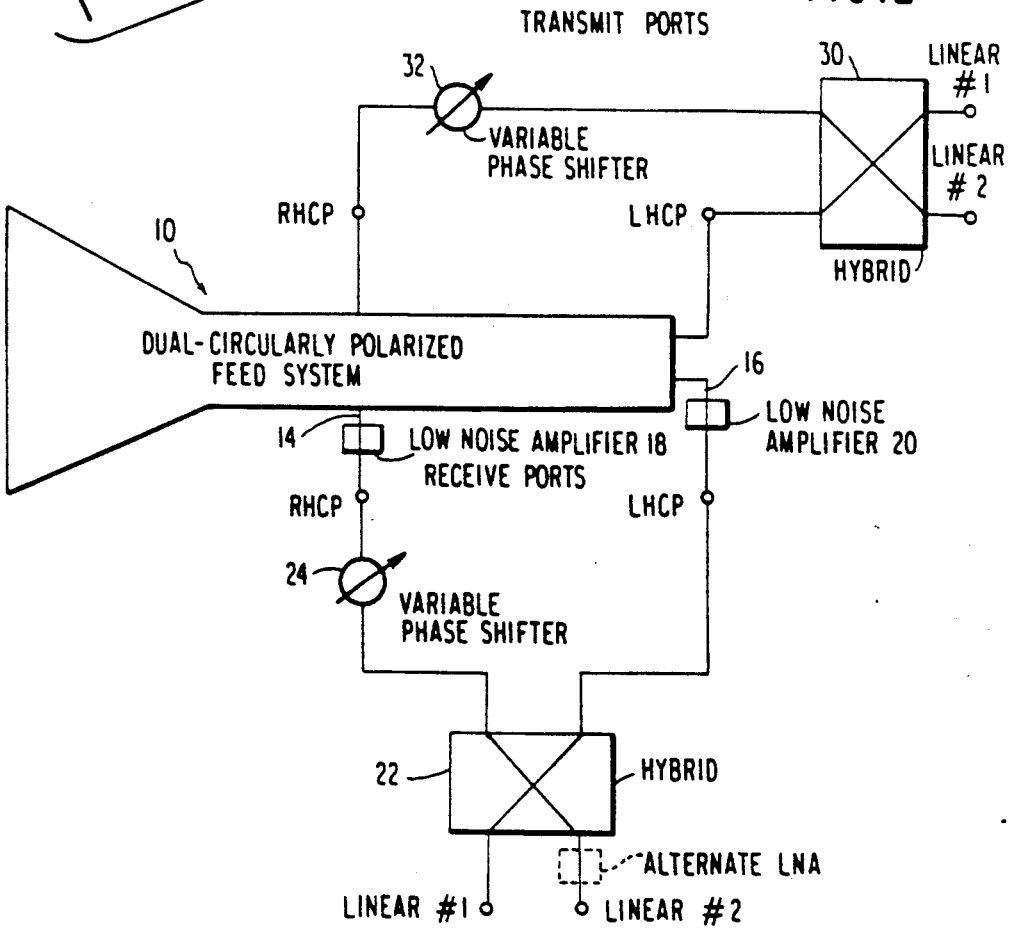

POLARIZATION CONVERTER APPLICATION FOR ACCESSING LINEARLY POLARIZED SATELLITES WITH SINGLE- OR DUAL-CIRCULARLY POLARIZED EARTH STATION ANTENNAS

BACKGROUND OF THE INVENTION

Transmission between satellites and earth stations is established by means of antennas which are either linearly or circularly polarized. In order to optimize satellite communication links, it is essential that the polarization of the earth station antenna be matched to the polarization of the satellite antenna. Thus, if circular polarization is employed on the satellite this is also the optimum for the earth station, and similarly for linear polarization. In many modern satellite communications systems the limited frequency resource is most efficiently used by employing dual, orthogonal polarization, and thus antenna polarization characteristics are of utmost importance in such systems.

If, e.g., a circularly polarized earth station antenna is being employed to receive a linearly polarized satellite signal, there will be a 3-dB power loss associated with the link due to the polarization mismatch. Moreover, if the satellite operates in dual-linear polarization, the interference between the two corresponding signals will be such as to prevent useful satellite communication.

If the above problems could be alleviated, earth stations, which often represent a significant investment, could be used for satellites other than those they were originally intended for, regardless of the polarization scheme. Additionally, if these problems could be solved in such a manner that alternative operation of an earth station in either circular or linear polarization is possible without significant additional cost, earth stations could be more readily designed to accommodate operations with both circularly and linearly polarized satellites. It would thus give the satellite operator greater flexibility, since satellites of differing polarization schemes could be substituted for each other during the life of the earth station without degradation of communications.

It is therefore an object of the present invention to provide a technique by which single- or dual-circularly polarized earth stations can be retro-fitted to access linearly polarized satellites with inexpensive and easily installed modifications to the existing earth station hardware, which are easily removed to recover the original configuration.

It is a further object of this invention to provide a means which allow, without significant additional expense or operational difficulty, earth stations to be designed and manufactured to accommodate either circularly or linearly polarized communications at any given time.

SUMMARY OF THE INVENTION

The above and other objects of the present invention are achieved by (1) disposing a free space meander line polarizer which provides a 90° differential phase shift in front of a circularly polarized antenna feed system and appropriately adjusting the orientation of the meander line polarizer, or (2) providing a power dividing (transmit) or power combining (receive) network in conjunction with differential phase shift circuits external to the existing feed system, to match a single- or dual-circularly polarized earth station antenna to a linearly polarized satellite system without reconfiguration or change of the existing earth station feed to recover the 3-dB power loss on the transmit and receive links and avoid the interference between dual-linearly polarized signals which would otherwise occur.

BRIEF DESCRIPTION OF THE DRAWINGS

The invention will be more clearly understood from the following description in conjunction with the accompanying drawings, wherein:

FIG. 1 illustrates the use of a meander line polarizer in conjunction with a circularly polarized earth station antenna to access a linearly polarized satellite; and FIG. 2 illustrates the use of a power dividing (transmit) and power combining (receive) network with associated differential phase shift circuits.

DETAILED DESCRIPTION OF THE INVENTION

For the benefit of clarity, the following description of the invention is limited to the situation in which a linearly polarized signal is transmitted from a satellite and received by the circularly polarized earth station antenna to which the invention is applied. The opposite situation, i.e., when signals are transmitted from the earth station to the satellite, follows immediately from the discussion by applying the reciprocity theorem of electromagnetic field theory.

The first embodiment of the present invention will be described with reference to FIG. 1, which illustrates the combination of a dual-circularly polarized earth station antenna feed system 10 and meander line polarizer 12 with 90° differential phase shift. The meander line polarizer 12, e.g., as described by Young, Robinson and Hacking in "Meander-Line Polarizer", IEEE Transactions on Antennas and Propagation, May 1973, pp. 376–378, converts the polarization of a linearly polarized plane wave, with its polarization aligned at an angle of 45° to the meander line, into a plane wave with circular polarization, provided the differential phase shift of the meander line polarizer is 90°. If two orthogonally linearly polarized plane waves which are both polarized at a 45° angle to the meander line are incident upon the polarizer, one will be converted into right hand circular polarization (RHCP) while the other will be converted into left hand circular polarization (LHCP). Thus, the two signals will still be orthogonal after transmission through the polarizer. If the angle is not 45°, then the transmitted signals will be elliptically polarized but still orthogonal.

Consider a satellite transmitting a linearly polarized signal to the ground. If a meander line polarizer is positioned in front of the feed of a circularly polarized earth station antenna at an arbitrary angle of rotation, it will convert the incoming signal into an elliptically polarized signal. This will be received by both the Right Hand Circular Polarization (RHCP) and Left Hand Circular Polarization (LHCP) ports of the feed system. By monitoring the power levels of these two signals while rotating the meander line polarizer in front of the feed, a position can be found at which one of the ports will show a maximum signal power level and the other at the same time a minimum. This corresponds to a 45° alignment of the polarizer with respect to the polarization of the incoming wave, and is the optimum position for receiving the linearly polarized signal. The same position is also optimum for receiving signals of the orthogonal linear polarization in which case the ports with maximum and minimum power will have changed roles.

It is noted that this embodiment of the invention has a minimum impact on the existing earth station, since it is easy to install and remove the polarizer from in front of the feed system and thus convert from or revert to original circular polarization, since the antenna and feed system remain conventional in all other respects. It is also noted that this invention is equally applicable to convert dual-circularly polarized earth station antennas into dual-linearly polarized antennas as it is to convert single-circularly polarized antennas into single-linearly polarized antennas.

A second embodiment of the invention will be described with reference to FIG. 2, which illustrates the use of power combiner and differential phase shift circuits in combination with the dual circularly polarized feed system 10. When a linearly polarized wave is transmitted from a satellite to a dual-circularly polarized earth station antenna, it will result in a signal on both the RHCP and the LHCP receive ports 14 and 16, respectively, of the antenna feed system. The two signals will each contain half the power of the original signal, and will have a phase difference depending upon the orientation of the incoming linearly polarized wave with respect to the polarizer of the circularly polarized feed system and the differential path lengths to the ports.

In this embodiment of the invention, the signals from the low noise amplifiers (LNAs) 18 and 20 connected to the RHCP and LHCP ports of the feed system are combined using a 3-dB hybrid 22 providing a 90° differential phase shift. Furthermore, a variable phase shifter 24 is inserted in one of the paths from the LNAs to the hybrid 22. By adjusting the phase shifter 24 while monitoring the signals on the two output ports of the hybrid, an adjustment can be found at which the signal at one port is maximum while it is minimum at the other port.

The position thus established is optimum for the particular orientation of the incident linearly polarized wave. It is also optimum for signals of the orthogonal linear polarization, in which case the two output ports from the hybrid would have reversed roles.

On the transmit side, the operation would be similar, with a linearly polarized signal being provided at one input to the hybrid 30 and split between its two outputs. One of the hybrid outputs would be coupled directly, i.e., with no phase shift, to one of the feed system transmit ports (the LHCP port in the illustrated example) and the other hybrid output would be coupled to the remaining transmit port through a variable phase shifter 32.

By adjusting the phase shifter 32, the spatial polarization orientation of the antenna feed system output can be matched with that of the antenna which will receive the feed system output signal (e.g., an on-board satellite antenna). When the orientation alignments are matched, the maximum power is transferred to the receive antenna and the position is optimum. The optimum alignment of the spatial polarization orientations can be verified by, for example, using a satellite loop-back carrier detection method.

It is noted that this embodiment of the invention will have a minimum impact on any existing earth station design and will allow for quick reversion to original circular polarization operation. It is also noted that this embodiment of the invention is not restricted to the use of hybrids but also applies to simpler power dividers, e.g., a magic tee. However, in that case it is only possible to employ single linear polarization.

Although the above description of the two embodiments of this invention is given in terms of transmission from a satellite to an earth station antenna, it is equally applicable to transmission from an earth station to a satellite. It is noted that for the first embodiment the optimal orientation angle is the same for both transmit and receive signals. On the other hand, for the second embodiment, it is necessary to implement one device to combine the transmit ports and one device to combine the receive ports, and to adjust the phase shifters of each of these circuits independently.

It should be noted that various changes and modifications could be made to the specific examples given above without departing from the spirit and scope of the invention as defined in the appended claims. It is to be emphasized that this embodiment of the invention is applicable to any two orthogonal linear polarizations. Further, while the variable phase shifters are illustrated as being coupled to the transmit and receive RHCP ports, they could instead be in the LHCP paths, or even one in an LHCP path and one in an RHCP path, as long as there is a means for shifting the phase of one received signal relative to another and one transmit signal relative to another.

Still further, while the LNAs 18 and 20 are illustrated as being as close as possible to the feed system consistent with common practice, the two LNAs 18 and 20 could be replaced with a single LNA at one output of the hybrid for reception of a single linear polarization. This would represent a cost savings, but at the expense of higher noise temperature.

What is claimed is:

1. An apparatus responsive to an input signal for transmitting corresponding linearly polarized signals, said apparatus comprising:

a dual-circularly polarized feed system having a left-hand circular polarization (LHCP) transmit port and a right-hand circular polarization (RHCP) transmit port; and polarization conversion means coupled to said LHCP and RHCP transmit ports and responsive to said input signal for providing a converted signal to said LHCP and RHCP transmit ports for causing said feed system to transmit signals linearly polarized in at least one direction.

2. An apparatus according to claim 1, wherein said polarization conversion means causes said feed system to transmit signals linearly polarized in two orthogonal directions.

3. An apparatus according to claim 1, wherein said polarization conversion means comprises power dividing means for receiving at least one signal and dividing it between first and second outputs, and coupling means for coupling one of said outputs to one of said LHCP and RHCP transmit ports while coupling the other of said first and second outputs to the other of said LHCP and RHCP transmit ports with a variable phase shift relative to said first output.

4. An apparatus according to claim 3, wherein said power dividing means is a hybrid divider.

5. An apparatus according to claim 3, wherein said power dividing means comprises a magic tee.

6. An apparatus for receiving linearly polarized signals, said apparatus comprising:

a dual-circularly polarized feed system having a left-hand circular polarization (LHCP) receive port and a right-hand circular polarization (RHCP) receive port; and polarization conversion means coupled to said LHCP and RHCP receive ports and responsive to signals provided to said receive ports by said feed system for detecting linearly polarized signals received by said feed system.

7. An apparatus according to claim 6, wherein said polarization conversion means comprises power combining means for receiving first and second signals at first and second combiner inputs and combining said first and second signals into a combiner output, and coupling means for coupling one of said LHCP and RHCP receive ports to said first combiner input while coupling the other of said LHCP and RHCP receive ports to said second combiner input with a variable phase shift with respect to said first combiner input.

8. An apparatus according to claim 7, wherein said power combining means is a hybrid combiner.

9. An apparatus according to claim 3, wherein said power combining means comprises a magic tee.

10. A method of transmitting linearly polarized signals corresponding to an input signal, via a dual-circularly polarized feed system having a left-hand circular polarization (LHCP) transmit port and a right-hand circular polarization (RHCP) transmit port, said method comprising the steps of:

providing said input signal; and passing said input signal to said LHCP and RHCP transmit ports via polarization conversion means to thereby cause said feed system to transmit signals linearly polarized in at least one direction.

11. A method of receiving linearly polarized signals, said method comprising the steps of:

receiving said linearly polarized signals via a dual-circularly polarized feed system having a left-hand circular polarization (LHCP) receive port and a right-hand circular polarization (RHCP) receive port; and passing output signals from said LHCP and RHCP receive ports through a polarization converter coupled to said LHCP and RHCP receive ports for detecting linearly polarized signals received by said feed system.

* * * * *